US011509993B2

(12) United States Patent
Lynch et al.

(10) Patent No.: US 11,509,993 B2
(45) Date of Patent: Nov. 22, 2022

(54) AMBIENT NOISE DETECTION USING A SECONDARY AUDIO RECEIVER

(71) Applicant: Avaya Management L.P., Santa Clara, CA (US)

(72) Inventors: John C. Lynch, Ontario (CA); Anthony Peter Neville Brown, Victoria (AU); Dustin John Laidsaar, Queensland (AU); Chee Fai Lee, Singapore (SG); Rayan Ahmed Mamun, Toronto (CA); Nina Yunusova, Ontario (CA)

(73) Assignee: Avaya Management, L.P., Santa Clara, CA (US)

( * ) Notice: Subject to any disclaimer, the term of this patent is extended or adjusted under 35 U.S.C. 154(b) by 0 days.

(21) Appl. No.: 17/007,159

(22) Filed: Aug. 31, 2020

(65) Prior Publication Data

US 2022/0070574 A1 Mar. 3, 2022

(51) Int. Cl.
*H04R 1/10* (2006.01)
*G10K 11/178* (2006.01)

(52) U.S. Cl.
CPC ..... *H04R 1/1083* (2013.01); *G10K 11/17837* (2018.01); *G10K 11/17881* (2018.01)

(58) Field of Classification Search
CPC ..... G10K 11/17881; G10K 11/17837; H04R 1/1083
USPC ..... 381/71.1
See application file for complete search history.

(56) References Cited

U.S. PATENT DOCUMENTS

| | | | | |
|---|---|---|---|---|
| 8,160,234 | B2 | 4/2012 | Diethom | |
| 9,031,205 | B2 | 5/2015 | Thomson et al. | |
| 2015/0071415 | A1* | 3/2015 | Thomson | H04M 3/5175 379/8 |
| 2017/0193978 | A1* | 7/2017 | Goldman | H04R 1/1083 |
| 2018/0225082 | A1* | 8/2018 | An | G06F 3/165 |
| 2020/0066133 | A1 | 2/2020 | Shekh-Yusef et al. | |

* cited by examiner

*Primary Examiner* — Paul Kim

(57) ABSTRACT

The technology disclosed herein enables ambient noise level determination at an endpoint using a secondary audio capture system for the endpoint. In a particular embodiment, a method includes during a communication session, receiving an audio signal representing sound captured by a secondary audio capture system for an endpoint on the communication session. A primary audio capture system for the endpoint captures voice communications from a user of the endpoint for the communication session. The method further determining an ambient noise level for the endpoint from the audio signal and, in response to determining that the ambient noise level satisfies a loudness criterion, presenting a notification to the user about the ambient noise level.

20 Claims, 7 Drawing Sheets

300

AMBIENT NOISE DETECTION USING A SECONDARY AUDIO RECEIVER

TECHNICAL BACKGROUND

When a user is participating in a communication session that captures audio of the user, such as a voice or video call, any noise captured beyond the user's own voice (i.e., the ambient noise around the user) can degrade the experience of one or more other parties on the communication session. For example, excessive ambient noise may make the user's voice harder to comprehend or may be otherwise distracting to the other parties. Moreover, when the user is a representative of an entity, such as a contact center agent, the excessive ambient noise may affect the other parties' sentiment towards the entity. Minimizing the amount of ambient noise around a user should, therefore, improve the communication session experience for the other parties on the communication session.

SUMMARY

The technology disclosed herein enables ambient noise level determination at an endpoint using a secondary audio capture system for the endpoint. In a particular embodiment, a method includes during a communication session, receiving an audio signal representing sound captured by a secondary audio capture system for an endpoint on the communication session. A primary audio capture system for the endpoint captures voice communications from a user of the endpoint for the communication session. The method further determining an ambient noise level for the endpoint from the audio signal and, in response to determining that the ambient noise level satisfies a loudness criterion, presenting a notification to the user about the ambient noise level.

In some embodiments, the secondary audio capture system comprises one or more microphones used for active noise canceling.

In some embodiments, a headset includes the secondary audio capture system, the primary audio capture system, and at least one speaker that presents audio for the communication session to the user.

In some embodiments, the ambient noise level comprises an audio power measurement and determining the ambient noise level includes calculating the audio power of the audio signal.

In some embodiments, the ambient noise level comprises a moving average of ambient noise level measurements over time.

In some embodiments, a plurality of endpoints for a contact center includes the endpoint and the method further includes performing a comparison between the ambient noise level and respective additional ambient noise levels determined for one or more other endpoints in the plurality of endpoints and directing a subsequent communication session to the endpoint based on the comparison. In those embodiments, the method may further include determining a location of the endpoint and respective other locations of the other endpoints and identifying loud areas of the contact center based on the location, the other locations, the ambient noise level, and the additional ambient noise levels.

In some embodiments, the method further includes, after the communication session and before a subsequent communication session, activating the secondary audio capture system to capture a second audio signal and determining a second ambient noise level for the endpoint from the second audio signal.

In some embodiments, a headset includes the primary audio capture system and at least one speaker that presents audio for the communication session to the user and the endpoint includes the secondary audio capture system.

In some embodiments, the method further includes determining a physical location of the endpoint and, in response to determining that the ambient noise level satisfies the loudness criterion, presenting the notification to users co-located at the physical location of the endpoint.

In another embodiment, an apparatus is provided having one or more computer readable storage media and a processing system operatively coupled with the one or more computer readable storage media. Program instructions stored on the one or more computer readable storage media that, when read and executed by the processing system, direct the apparatus to during a communication session, receive an audio signal representing sound captured by a secondary audio capture system for an endpoint on the communication session. A primary audio capture system for the endpoint captures voice communications from a user of the endpoint for the communication session to determine an ambient noise level for the endpoint from the audio signal and, in response to determining that the ambient noise level satisfies a loudness criterion, present a notification to the user about the ambient noise level.

DETAILED DESCRIPTION

Mitigating ambient noise around a user on a communication session having an audio component may help improve the experience of one or more other parties on that communication session. Those other parties may be able to understand the user better (e.g., hear the user's voice better relative to the ambient noise captured along with the user's voice) and may be less distracted by sounds in the ambient noise (e.g., won't be tempted to pay attention to what is going on in the background rather than to the user's voice). The technology described below determines the ambient noise level at communication endpoints and determines whether the ambient noise level at the respective endpoints warrants mitigation. Specifically, the ambient noise at a given endpoint is captured via a secondary audio capture system for the endpoint while a primary audio capture system for the endpoint is tasked with capturing the endpoint user's voice when the user is participating in a communication session. If the ambient noise level is too high, action(s) may be taken to mitigate the ambient noise level.

Figure 1:
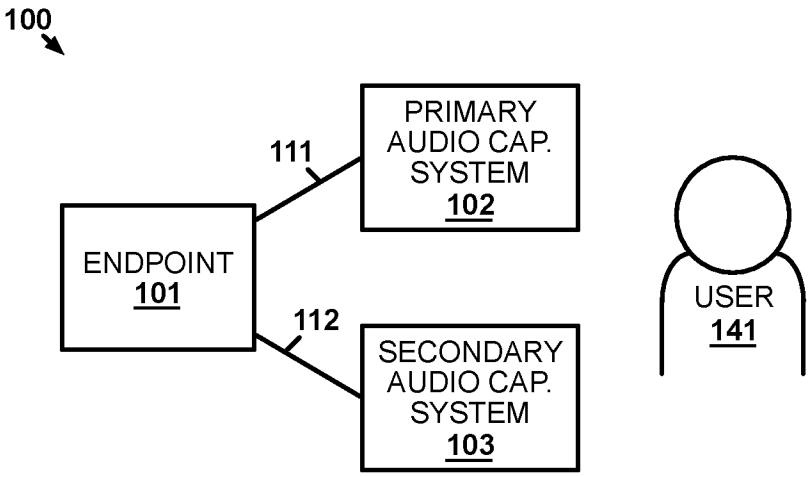
FIG. 1 illustrates an implementation for detecting ambient noise at an endpoint.

FIG. 1 illustrates implementation 100 for detecting ambient noise at an endpoint. Implementation 100 includes endpoint 101, primary audio capture system 102, and secondary audio capture system 103. Endpoint 101 and primary audio capture system 102 communicate over communication link 111. Endpoint 101 and secondary audio capture system 103 communicate over communication link 112. Endpoint 101 may be a telephone, laptop, personal computer, tablet computer, or some other type of user operable computing device. Though shown as separate devices, either or both of primary audio capture system 102 and secondary audio capture system 103 may be incorporated into endpoint 101. Similarly, primary audio capture system 102 and secondary audio capture system 103 may be incorporated into a device and communicate with endpoint 101 over a single communication link. Communication links 111-112 may be wired or wireless links with endpoint 101 or may be internal links, including system buses, in examples where primary audio capture system 102 and/or secondary audio capture system 103 are incorporated into the endpoint 101 device.

In operation, primary audio capture system 102 and secondary audio capture system 103 may each comprise one or more microphones, or other type of element, for capturing sound and producing an audio signal, either digital or analog, representing that sound. Secondary audio capture system 103 is secondary in the sense that it is not currently being used to capture the user 141's voice for use as an audio component of a communication session. For example, aside from the abilities enabled herein, secondary audio capture system 103 may be primarily, or exclusively, used for purposes other than capturing user 141's voice (e.g., may be used for active noise cancellation purposes). Alternatively, secondary audio capture system 103 may be configured to capture user 141's voice when directed to do so. For instance, secondary audio capture system 103 may comprise a microphone for handsfree (e.g., speakerphone) operation of endpoint 101 where the handsfree function is not currently enabled (e.g., endpoint 101 is not currently connected to a communication session or another capture system, such as primary audio capture system 102, is currently being used to capture user 141's voice). Primary audio capture system 102 is an audio capture system for endpoint 101 other than secondary audio capture system 103. Primary audio capture system 102 is an audio capture system that can capture user 141's voice for transmission by endpoint 101 over a communication session. For example, primary audio capture system 102 may comprise one or more microphones in a handset or headset connected to endpoint 101. Similar to secondary audio capture system 103, Primary audio capture system 102 may also comprise a handsfree microphone because the handsfree microphone can capture user 141's voice for a communication session. Although, in those examples, primary audio capture system 102 would need to be a different microphone (e.g., a microphone in a headset or handset).

Figure 2:
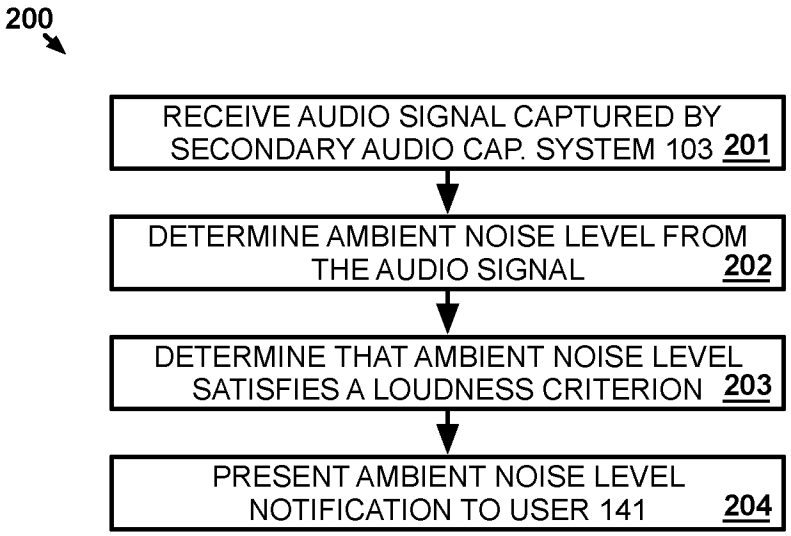
FIG. 2 illustrates an operational scenario that detects ambient noise at an endpoint.

FIG. 2 illustrates operational scenario 200 that detects ambient noise at an endpoint. In operational scenario 200, endpoint 101 is connected to a communication session with at least one other endpoint. The communication session may be established over one or more communication networks and is configured to at least exchange real-time voice communications for participants on the communication session, including user 141, although other types of communications may be exchanged as well (e.g., video, screen sharing, text chat, etc.).

During the communication session, an audio signal representing sound captured by secondary audio capture system 103 is received by endpoint 101 (201). Primary audio capture system 102 captures voice communications from user 141 for the communication session. The sound captured by secondary audio capture system 103 is representative of the ambient noise around user 141 at the physical location of endpoint 101 and user 141. Since primary audio capture system 102 is used to capture the voice of user 141, secondary audio capture system 103 is preferably positioned such that user 141's voice is not the predominant component of the sound, although user 141's voice may still be in the sound. For example, the microphone(s) in secondary audio capture system 103 may be directed away from where user 141's mouth is expected to be positioned (e.g., pointed outward from the earpieces of a headset) or may be located farther away from where user 141's mouth is expected to be (e.g., on endpoint 101 instead of on a headset worn by user 141 with primary audio capture system 102.

As noted above, secondary audio capture system 103 converts the captured sound into an audio signal that may be digital (e.g., a bit stream, packet, or other digital format representing the sound waveform) or analog (e.g., an electrical waveform corresponding to the sound waveform). In some examples, secondary audio capture system 103 may include multiple capture elements (e.g., microphones) that capture sound. The sound captured from those elements may be combined into a single audio signal (e.g., using different audio channels or merging signals together) or a separate audio signal may be received for each element. In this example, secondary audio capture system 103 is co-located with endpoint 101 and endpoint 101 performs operational scenario 200. Therefore, endpoint 101 may receive the audio signal over a direct wireless (e.g., Bluetooth) or wired connection (e.g., via a 3.5-millimeter headphone jack or Universal Serial Bus). In other examples, the audio signal may be received over a more indirect link, such as over a communication network. In those examples, the audio signal may be digitized, if it was not already, and placed into data packets for transport. Endpoint 101 may still perform operational scenario 200 in those examples or a remote computing system may perform operational scenario 200 and, therefore, receive the audio signal over a communication network.

From the received audio signal, endpoint 101 determines an ambient noise level for the endpoint from the audio signal (202). The ambient noise level is representative of how loud the sound is around user 141 as captured by secondary audio capture system 103. The ambient noise level may be based on the amplitude of the sound waves represented by the audio signal with greater amplitudes corresponding to greater levels of noise. In some examples, the ambient noise level may be an average noise level over an amount of time long enough to prevent outlier noise level measurements from affecting the ambient noise level determination. For example, the ambient noise level at a location may be relatively quiet but, at one point, something happens that is very loud (e.g., someone drops dishes). That loud occurrence should have minimal effect on the average noise level assuming that the time period chosen for calculating the ambient noise level is long enough such that quieter noise levels outweigh the noise level of the loud occurrence. In some examples, the average is a moving average that allows the ambient noise level to be calculated continually over-time. As time passes, the period of time used for calculating the average moves with the passing of time. For example, the ambient noise level may be continually (e.g., every second) calculated as the average noise level for the past 30 seconds.

In some examples, the ambient noise level may be represented as a power level of the sound captured by secondary audio capture system 103 as represented by the audio signal. Power may be represented using absolute units (e.g., in Watts) or using relative units (e.g., decibel). Regardless of units, higher power levels indicate higher noise levels. When calculating the power level of the sound from the audio signal, the calculating system will need to know how the amplitude of the audio signal corresponds to the level of the sound being represented thereby. For example, a line level analog signal will use higher voltages than a mic level analog signal representing the same sound, which results in higher amplitudes for the line level signal. In some examples, secondary audio capture system 103 itself may be configured to determine the ambient noise level and transfer the results of the calculations to endpoint 101.

Endpoint 101 further determines whether the ambient noise level determined above satisfies a loudness criterion (203). The loudness criterion may be a threshold value that the ambient noise level must rise above in order for loudness criterion to be satisfied. For example, the threshold may define a certain number of decibels and, when the ambient noise level rises above that certain number of decibels, the loudness criterion is satisfied. In other examples, the criterion may be more complex and/or may be one of multiple criterion. For instance, rather than simply needing to exceed the threshold once, the ambient noise level may need to exceed the threshold a predefined number of times or stay above the threshold a predefined amount of time.

In response to determining that the ambient noise level satisfies the loudness criterion, endpoint 101 presents a notification to user 141 about the ambient noise level (204). The notification may be visual, audible, haptic, or some other manner of conveying information to a human user—including combinations thereof. A visual notification may be a graphic on a display screen of endpoint 101, powering on a light emitting diode (e.g., in a particular color, lighting pattern, pattern of different colors, etc.), powering on multiple light emitting diodes, or some other visual manner of conveying information. An audible notification may be a synthesized or prerecorded voice played back using a speaker system of endpoint 101, an audible tone, a sequence or pattern of tones, or some other audible manner of conveying information. A haptic notification may be a vibration, pattern of vibrations, application of pressure to the user, or some other haptic manner of conveying information. The notification may simply indicate to the user that the ambient noise level has satisfied the criterion (e.g., is too loud) or may provide additional information. The additional information may include instructions for lowering the ambient noise level, ramifications for not lowering the ambient noise level, or other information that may be useful to user 141 with respect to the ambient noise level satisfying the criterion. It should be understood that, if a system remote to endpoint 101 performs operational scenario 200, then the remote system will transfer the notification to endpoint 101 to present the notification to user 141.

Advantageously, operational scenario 200 uses secondary audio capture system 103, which would otherwise go unused or be used for other purposes, to notify user 141 when the ambient noise level becomes too loud (i.e., satisfies the criterion). The notification increases the likelihood that user 141 can address the noise level and, as a result, improve the communications session experience for other parties on the communication session. Other examples may perform different/additional actions in response to determining that the ambient noise level satisfies the criterion. For example, if endpoint 101 is one of many endpoints in a contact center, the contact center may determine to which endpoint(s) communications should be routed based on the ambient noise level determinations at the endpoints. In another example, an administrator may be notified that, based on the ambient noise levels, a certain location (e.g., an area around similarly located endpoints) is noisier than other areas and take action to remedy the issue.

Figure 3:
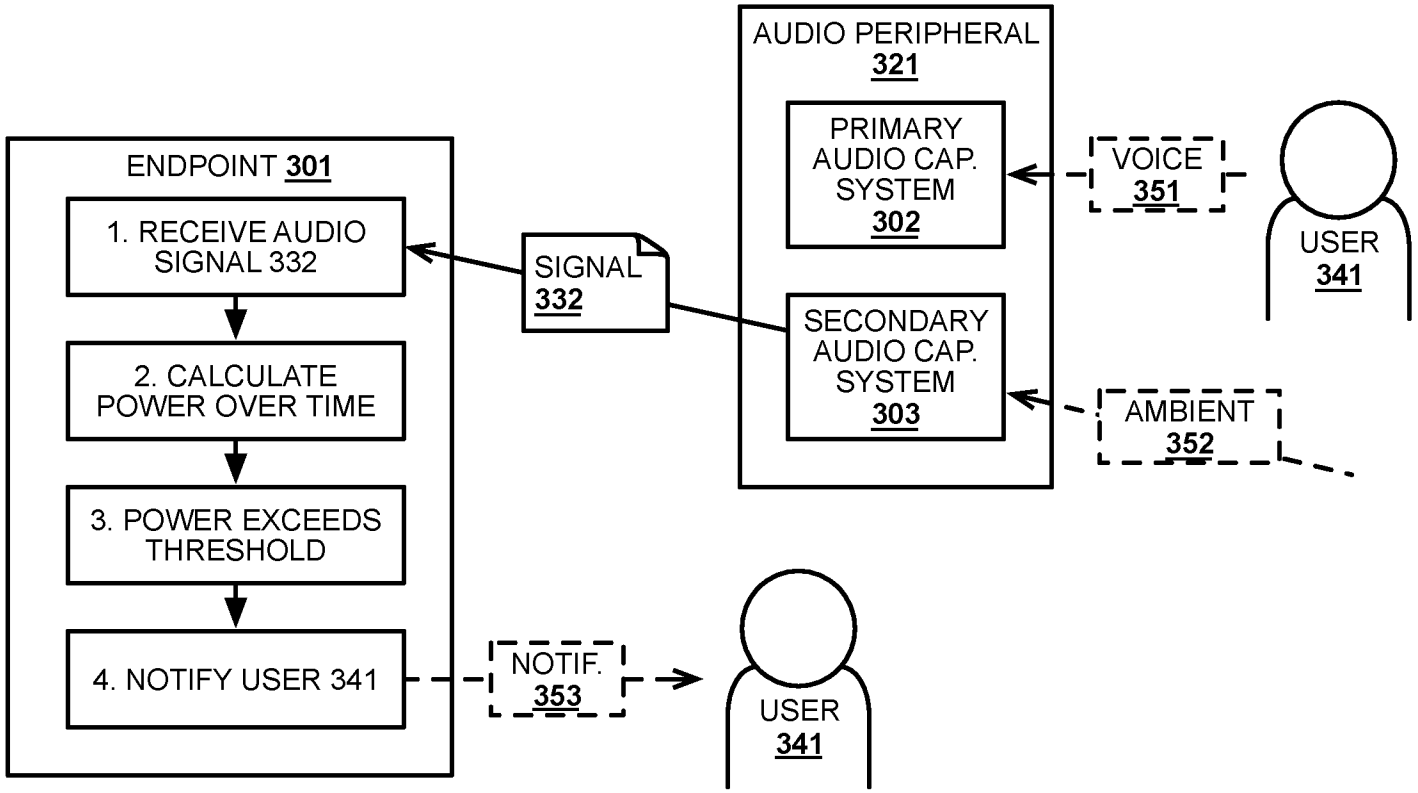
FIG. 3 illustrates another operational scenario that detects ambient noise at an endpoint.

FIG. 3 illustrates operational scenario 300 that detects ambient noise at an endpoint. In operational scenario 300, endpoint 301 is an example of endpoint 101, primary audio capture system 302 is an example of primary audio capture system 102, and secondary audio capture system 303 is an example of secondary audio capture system 103. User 341 operates endpoint 301 and uses audio peripheral 321 to participate in communication sessions for which endpoint 301 is an endpoint. Audio peripheral 321 may be a handset held by user 341 or headset worn by user 341. In this example, primary audio capture system 302 and secondary audio capture system 303 are components of the same audio peripheral 321. Although, in other examples, primary audio capture system 302 and secondary audio capture system 303 may be components of separate peripherals or built into endpoint 301. Audio peripheral 321 may include wireless and/or wired communication circuitry for communicating with endpoint 301.

In operational scenario 300, primary audio capture system 302 is configured to capture voice 351 of user 341 to transfer over a communication session. Though not shown, an audio signal representing voice 351 is transferred to endpoint 301 for inclusion on the communication session. Secondary audio capture system 303 is configured to capture ambient noise 352 at least for the purposes described below. Secondary audio capture system 303 may also capture ambient noise 352 for other purposes, such as to perform active noise cancellation for audio peripheral 321. As ambient noise 352 is captured, secondary audio capture system 303 converts ambient noise 352 to audio signal 332 and transfers audio signal 332 to endpoint 301 in real time over the link between audio peripheral 321 and endpoint 301. The circuitry used by secondary audio capture system 303 to generate audio signal 332 may be shared with other components of audio peripheral 321, such as primary audio capture system 302.

Endpoint 301 receives audio signal 332 at step 1 from secondary audio capture system 303. As audio signal 332 is received, endpoint 301 calculates the power level of ambient noise 352 at step 2 based on audio signal 332. In this example, since audio signal 332 is received in real time, endpoint 301 also calculates the power in real time so endpoint 101 can notify user 341 in real time, as discussed below. The power may be measured as power for a given moment in time for the signal (e.g., the power for the most recently received time in the signal) or an average power over a period of time, such as the last 10 seconds. In the latter examples, the average power for the period of time may be calculated for sequential discrete periods (e.g., for each 10 second interval) or the period may constantly move as more of audio signal 332 is received for more continual power determination over time.

Endpoint 301 further determines at step 3 whether the power level exceeds a threshold power level. The power level may simply need to exceed the threshold once, exceed the threshold multiple times (e.g., for a number of power level determinations in sequence if the power level over time is determined in discrete instances, such as one for every 10 second interval), may need to remain above the threshold for a period of time, or some other manner in which the determined power level could be considered to have exceeded the threshold. In response to determining that the threshold has been exceeded, endpoint 301 presents notification 353 at step 4 to user 341. In this example, notification 353 indicates that ambient noise 352 is too loud and allows user 341 to act upon that information as desired. In other examples, notification 353 may provide other information, such as instructions for user 341 to move to a quieter area or otherwise take measures to reduce ambient noise 352.

Figure 4:
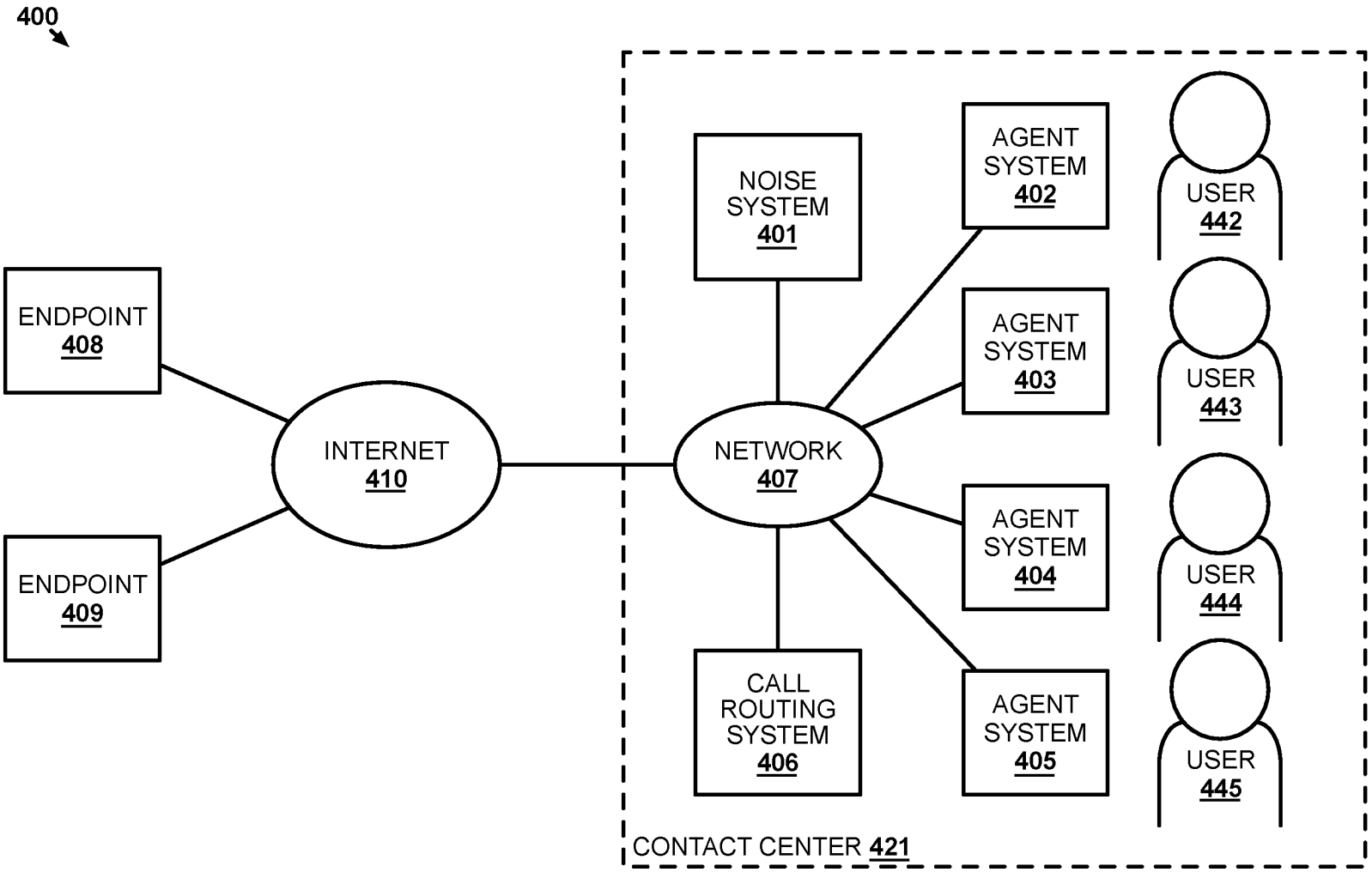
FIG. 4 illustrates another implementation for detecting ambient noise at an endpoint.

FIG. 4 illustrates implementation 400 for detecting ambient noise at an endpoint. Implementation 400 includes noise determination system 401, agent systems 402-405, call routing system 406, communication network 407, endpoints 408-409, and Internet 410. Noise determination system 401, agent systems 402-405, and communication network 407 are part of contact center 421 and communicate with each other over communication network 407. Users 442-445 operate respective agent systems 402-405 and are agents working in contact center 421 to handle calls (voice or video with a voice component) with users outside of contact center 421 (e.g., with customers of an entity operating contact center 421). Contact center 421 may be located in a single physical facility or may be distributed among multiple physical locations (e.g., multiple facilities, agent homes, etc.). As such, communication network 407 may be implemented, in part, over Internet 410 to connect multiple physical locations.

In operation, call routing system 406 determines which of users 442-445 should handle a call with contact center 421. The calls may be incoming or outgoing from contact center 421. When a user of users 442-445 is selected for a call, call routing system 406 routes the call to the associated agent system of agent systems 402-405 operated by the selected user (e.g., the selected user is logged into call routing system 406 using the associated agent system). Noise determination system 401, as discussed below, collects ambient noise readings from agent systems 402-405 and manages contact center 421 in accordance with those ambient noise readings (e.g., provides routing instructions to call routing system 406, makes noise abatement recommendations, etc.).

Figure 5:
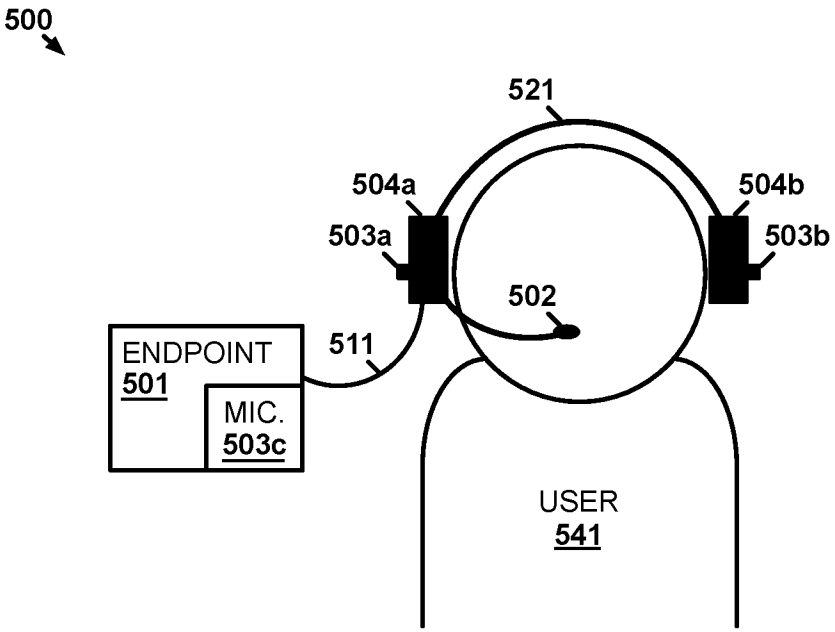
FIG. 5 illustrates implementation for detecting ambient noise at an endpoint.

FIG. 5 illustrates implementation 500 for detecting ambient noise at an endpoint. Implementation 500 is an example an agent system of agent systems 402-405 with a corresponding user of users 442-445. The agent system of implementation 500 includes endpoint 501 and headset 521. Headset 521 includes microphone 502, microphones 503*a-b*, and speakers 504*a-b*. Endpoint 501 includes microphone 503*c*. Headset 521 and endpoint 501 are connected via a wired headset link 511, although other examples may include a wireless headset link 511.

In operation, headset 521 is worn by user 541 participate in the voice component of calls with contact center 421. Microphone 502 is positioned on a microphone boom of headset 521 and is the primary audio capture system for endpoint 501 when headset 521 is connected to endpoint 501. The sound captured by microphone 502 during a call is represented by an audio signal used by endpoint 501 to transmit user 541's voice over the call. Sound for the audio received from one or more other endpoints on the call is reproduced for user 541 by speakers 504*a-b*. In this example, one or more of microphones 503*a-c* are used as a secondary audio capture system for endpoint 501. Microphones 503*a-b* may be microphones on each side of headset 521 that headset 521 uses to capture ambient noise for the purpose of performing active noise cancellation (using processing circuitry in headset 521) through microphones 503*a-b*. Microphone 503*c* is a microphone built into endpoint 501 and may be used as a primary audio capture system when endpoint 501 is placed in a speaker phone mode. However, since microphone 502 is used as the primary audio capture system in this example, microphone 503*c* can be used as part of a secondary audio capture system. Though not shown as an example in implementation 500, a microphone 503 may be located on the boom of headset 521 with microphone 502. Although, since a microphone 503 on the boom is not purposed for capturing the voice of user 541 (e.g., may be purposed for noise cancellation like microphones 503*a-b*), the microphone 503 may be directed away from user 541 while microphone 502 is directed towards user 541 to capture user 541's voice. Regardless of which of microphones 503*a-c* are included in the secondary audio capture system, microphone(s) 503 capture sound around endpoint 501 and user 541 such that the ambient noise can be used in the manner described in operational scenario 600.

Figure 6:
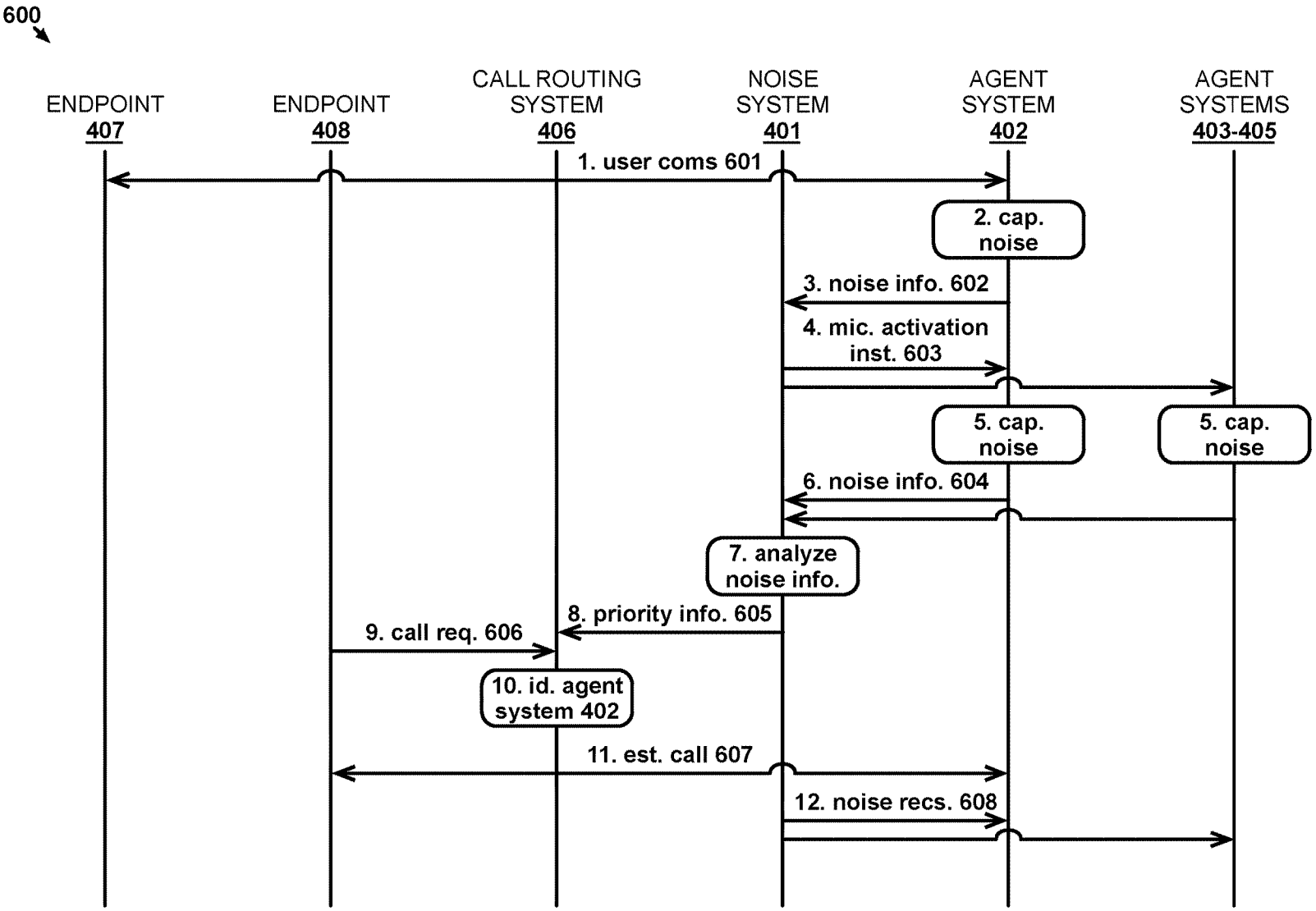
FIG. 6 illustrates an operational scenario that detects ambient noise at an endpoint.

FIG. 6 illustrates operational scenario 600 that detects ambient noise at an endpoint. Operational scenario 600 begins with agent system 402 already exchanging user communications 601 at step 1 for a call with communication network 407. User communications 601 include voice communications captured from user 442 by microphone 502 at noise determination system 401. User communications 601 may similarly include voice communications captured from one or more users operating communication network 407. While user communications 601 are shown passing through call routing system 406, it should be understood that user communications 601 may not pass through call routing system 406 and/or may pass through other systems. During the exchange of user communications 601 for the call, agent system 402 captures the ambient noise surrounding agent system 402 and user 442 at step 2 via one or more of microphones 503*a-c* at agent system 402. In this example, software executing on endpoint 501 of agent system 402, such as a telecommunications soft client if endpoint 501 is a personal computer or device firmware if endpoint 501 is a desk phone, directs endpoint 501 to capture ambient noise via one or more of microphones 503*a-c*.

The software further directs agent system 402 to transfer noise information 602 at step 3 to noise determination system 401. Noise information 602 includes any information that noise determination system 401 may need to determine a power level of the ambient noise at agent system 402. In some examples, noise information 602 may include an audio signal representing the ambient noise so that noise determination system 401 can determine a power level of the ambient noise itself. In those examples, the audio signal may be transferred continually (e.g., streamed) to noise determination system 401 so that noise determination system 401 can determine a moving average of the power level of the ambient noise as the call progresses. In other examples, the power level of the ambient noise may be calculated at agent system 402 and transferred to noise determination system 401 in noise information 602. In those examples, agent system 402 may transfer the current or average power level periodically, in response to the power level exceeding a threshold power level, or on some other schedule during the call.

When agent systems 402-405 are not on calls, noise determination system 401 further transfers a microphone activation instruction 603 at step 4 to each of agent systems 402-405. Upon receipt of microphone activation instruction 603, endpoint 501 in each of agent systems 402-405 activates one or more of their respective microphones 503*a-c* to capture ambient noise at step 5. In one example, the software executing on endpoint 501 of each of agent systems 402-405 may use a device driver or a call to an operating system of endpoint 501 to enable sound capture through one or more of microphones 503*a-c* even though endpoint 501 is not otherwise being used for voice communications. Noise information 604 is transferred at step 6 from each of agent systems 402-405 to noise determination system 401. Noise information 604 is similar to noise information 602 and may, therefore, include an audio signal from each of agent systems 402-405 that represents the ambient noise thereat or a value(s) for a power level of the ambient noise.

While this example captures ambient noise and transfers noise information 604 in response to microphone activation instruction 603, other examples may perform the capture and transfer for alternative reasons. For example, agent systems 402-405 may be configured to automatically capture and transfer noise information 604 periodically (e.g., once every ten minutes). Likewise, while steps 4-6 occur at the same time for all of agent systems 402-405, the steps may be performed at different times.

From the received noise information 602 and noise information 604, noise determination system 401 analyzes noise information 602 and noise information 604 to determine how the ambient noise in the vicinity of agent systems 402-405 should affect call routing within contact center 421. Essentially, the analysis is performed, at least in part, to determine whether the ambient noise present at any of agent systems 402-405 is loud enough to warrant calls not being routed thereto due to the potential for adverse effects on voice conversation. Noise determination system 401 applies at least one criterion, such as the threshold(s) described above, to the ambient noise levels included in, or determined from, noise information 602 and noise information 604 to determine whether any of agent systems 402-405 should not have calls routed thereto or should be prioritized lower relative to agent systems that do not satisfy the at least one criterion for being too loud. In some examples, a criterion may cause noise determination system 401 to prioritize agent systems 402-405 in order of loudest to quietest ambient noise based on a comparison between the respective ambient noise levels at agent systems 402-405. In those examples, noise determination system 401 may still leave agent systems that are too loud (e.g., exceed a threshold noise level) out of the priority all together.

In addition to determining ambient noise levels for individual agent systems, noise determination system 401 may also determine noise levels more broadly for physical locations in which the agent systems are located. For example, agent systems 402-403 may be located in one area of contact center 421 (e.g., within a certain number of feet, in a same cubicle, or otherwise). The location of agent systems 402-403 may be known to noise determination system 401 based on information received from agent systems 402-403 themselves, from a user, from floor plan data about locations of agent systems in contact center 421, or from some other source. Noise determination system 401 may analyze the noise information from agent systems 402-403 and, if the noise information indicates that the ambient noise is too loud at both agent systems, the location of agent systems 402-403 is most likely loud. Noise determination system 401 may then make determinations based around the location as a whole (and other locations with agent systems) rather than just the individual agent systems. For example, noise determination system 401 may prioritize call routing to the location as a whole, including agent systems at the location that did not provide noise information to noise determination system 401, rather than on an individual agent system basis. Likewise, recommendations to mitigate ambient noise (e.g., noise recommendations 608 discussed below) can be made with respect to physical locations as a whole rather than individual agent systems thereat.

Noise determination system 401 transfers priority information 605 at step 8 to call routing system 406. Priority information 605 indicates a priority in which agent systems 402-405 should have calls routed to them based on the analysis performed in step 7. Agent system 402 may use priority information 605 alone to determine to which of agent systems 402-405 a call should be routed or may use priority information 605 in addition to other information relevant to call routing, such as agent skillsets, agent ratings, call topic, etc. As noise determination system 401 receives additional noise information from agent systems 402-405 (e.g., from continuing to receive additional noise information 604), noise determination system 401 may update and transfer priority information 605 to provide call routing system 406 with updated prioritizations of agent systems 402-405.

Call routing system 406 receives call request 606 at step 9 from endpoint 408. Call request 606 is a request to establish call 607 with contact center 421 so that the user of endpoint 408 can speak with an agent of contact center 421. In response to the request, call routing system 406 determines which of agent systems 402-405 should handle call 607 based at least on priority information 605. In this example, call routing system 406 selects agent system 402 at step 10. Call routing system 406 then establishes call 607 between endpoint 408 and agent system 402 at step 11 in accordance with the selection. After establishment, voice communications can be exchanged between user 442 and the user of endpoint 408.

In addition to determining a prioritization for call routing, noise determination system 401 transfers noise recommendations 608 at step 12 to those of agent systems 402-405 that were determined to be too loud at step 7. Noise recommendations 608 are presented by the receiving agent systems to their users. Noise recommendations 608 may simply indicate that the ambient noise is too loud at the agent system, or at the agent system's more broad location, which relies on the user to determine how to handle the ambient noise. Alternatively, noise recommendations 608 may provide instructions or suggestions for reducing noise. The instructions may be generic based on common reasons for ambient noise being too loud (e.g., too much background talking or loud music) or noise determination system 401 may be able to process noise information received from agent systems 402-405 to determine a noise source to create a more specific instruction (e.g., noise determination system 401 may recognize traffic noise from analysis of an audio signal in the noise information and may recommend closing a window).

Advantageously, in operational scenario 600, noise determination system 401 is able to leverage microphones 503*a-c*, which would otherwise go unused or be used for other purposes, at each agent systems 402-405 to better ensure that a call with contact center 421 is not adversely affected by too much ambient noise.

Figure 7:
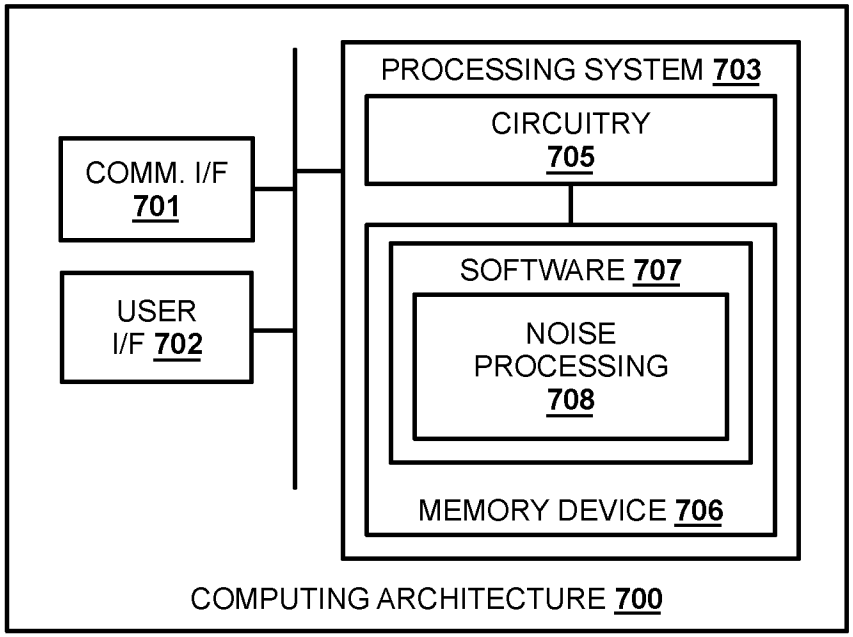
FIG. 7 illustrates a computing architecture for detecting ambient noise at an endpoint.

FIG. 7 illustrates computing architecture 700 for detecting ambient noise at an endpoint. Computing architecture 700 is an example computing architecture for endpoint 101, endpoint 301, endpoint 501, and noise determination system 401, although systems 101, 301, 501, and 401 may use alternative configurations. A similar architecture may also be used for other systems described herein (e.g., call routing system 406), although alternative configurations may also be used. Computing architecture 700 comprises communication interface 701, user interface 702, and processing system 703. Processing system 703 is linked to communication interface 701 and user interface 702. Processing system 703 includes processing circuitry 705 and memory device 706 that stores operating software 707.

Communication interface 701 comprises components that communicate over communication links, such as network cards, ports, RF transceivers, processing circuitry and software, or some other communication devices. Communication interface 701 may be configured to communicate over metallic, wireless, or optical links. Communication interface 701 may be configured to use TDM, IP, Ethernet, optical networking, wireless protocols, communication signaling, or some other communication format—including combinations thereof.

User interface 702 comprises components that interact with a user. User interface 702 may include a keyboard, display screen, mouse, touch pad, or some other user input/output apparatus. User interface 702 may be omitted in some examples.

Processing circuitry 705 comprises microprocessor and other circuitry that retrieves and executes operating software 707 from memory device 706. Memory device 706 comprises a computer readable storage medium, such as a disk drive, flash drive, data storage circuitry, or some other memory apparatus. In no examples would a storage medium of memory device 706 be considered a propagated signal. Operating software 707 comprises computer programs, firmware, or some other form of machine-readable processing instructions. Operating software 707 includes noise processing module 708. Operating software 707 may further include an operating system, utilities, drivers, network interfaces, applications, or some other type of software. When executed by processing circuitry 705, operating software 707 directs processing system 703 to operate computing architecture 700 as described herein.

In particular, noise processing module 708 directs processing system 703 to, during a communication session, receive an audio signal representing sound captured by a secondary audio capture system for an endpoint on the communication session. A primary audio capture system for the endpoint captures voice communications from a user of the endpoint for the communication session. Noise processing module 708 further directs processing system 703 to determine an ambient noise level for the endpoint from the audio signal and, in response to determining that the ambient noise level satisfies a loudness criterion, presenting a notification to the user about the ambient noise level.

The descriptions and figures included herein depict specific implementations of the claimed invention(s). For the purpose of teaching inventive principles, some conventional aspects have been simplified or omitted. In addition, some variations from these implementations may be appreciated that fall within the scope of the invention. It may also be appreciated that the features described above can be combined in various ways to form multiple implementations. As a result, the invention is not limited to the specific implementations described above, but only by the claims and their equivalents.

What is claimed is:

1. A method for detecting ambient noise, the method comprising:

during a communication session, receiving an audio signal representing sound captured by a secondary audio capture system for an endpoint on the communication session, wherein a primary audio capture system for the endpoint captures voice communications from a user of the endpoint for the communication session;

determining an ambient noise level for the endpoint from the audio signal;

determining that the ambient noise level satisfies a loudness criterion, wherein the loudness criterion is satisfied when the ambient noise level exceeds a threshold value; and in response to determining that the ambient noise level satisfies the loudness criterion, presenting a notification to the user indicating that the ambient noise level has exceeded the threshold value.

2. The method of claim 1, wherein the secondary audio capture system comprises one or more microphones used for active noise canceling.

3. The method of claim 1, wherein a headset includes the secondary audio capture system, the primary audio capture system, and at least one speaker that presents audio for the communication session to the user.

4. The method of claim 1, wherein the ambient noise level comprises an audio power measurement, and wherein determining the ambient noise level comprises:

calculating the audio power of the audio signal.

5. The method of claim 1, wherein the ambient noise level comprises a moving average of ambient noise level measurements over time.

6. The method of claim 1, wherein a plurality of endpoints for a contact center includes the endpoint, and wherein the method further comprises:

performing a comparison between the ambient noise level and respective additional ambient noise levels determined for one or more other endpoints in the plurality of endpoints; and directing a subsequent communication session to the endpoint based on the comparison.

7. The method of claim 6, further comprising:

determining a location of the endpoint and respective other locations of the other endpoints; and identifying loud areas of the contact center based on the location, the other locations, the ambient noise level, and the additional ambient noise levels.

8. The method of claim 1, further comprising:

after the communication session and before a subsequent communication session, activating the secondary audio capture system to capture a second audio signal; and determining a second ambient noise level for the endpoint from the second audio signal.

9. The method of claim 1, wherein:

a headset includes the primary audio capture system and at least one speaker that presents audio for the communication session to the user; and the endpoint includes the secondary audio capture system.

10. The method of claim 1, further comprising:

determining a physical location of the endpoint; and in response to determining that the ambient noise level satisfies the loudness criterion, presenting the notification to users co-located at the physical location of the endpoint.

11. An apparatus for detecting ambient noise, the apparatus comprising:

one or more computer readable storage media;

a processing system operatively coupled with the one or more computer readable storage media; and program instructions stored on the one or more computer readable storage media that, when read and executed by the processing system, direct the apparatus to:

during a communication session, receive an audio signal representing sound captured by a secondary audio capture system for an endpoint on the communication session, wherein a primary audio capture system for the endpoint captures voice communications from a user of the endpoint for the communication session;

determine an ambient noise level for the endpoint from the audio signal;

determine that the ambient noise level satisfies a loudness criterion, wherein the loudness criterion is satisfied when the ambient noise level exceeds a threshold value; and in response to determining that the ambient noise level satisfies the loudness criterion, present a notification to the user indicating that the ambient noise level has exceeded the threshold value.

12. The apparatus of claim 11, wherein the secondary audio capture system comprises one or more microphones used for active noise canceling.

13. The apparatus of claim 11, wherein a headset includes the secondary audio capture system, the primary audio capture system, and at least one speaker that presents audio for the communication session to the user.

14. The apparatus of claim 11, wherein the ambient noise level comprises an audio power measurement, and wherein to determine the ambient noise level, the program instructions direct the processing system to:

calculate the audio power of the audio signal.

15. The apparatus of claim 11, wherein the ambient noise level comprises a moving average of ambient noise level measurements over time.

16. The apparatus of claim 11, wherein a plurality of endpoints for a contact center includes the endpoint, and wherein the program instructions further direct the apparatus to:

perform a comparison between the ambient noise level and respective additional ambient noise levels determined for one or more other endpoints in the plurality of endpoints; and direct a subsequent communication session to the endpoint based on the comparison.

17. The apparatus of claim 16, wherein the program instructions further direct the apparatus to:

determine a location of the endpoint and respective other locations of the other endpoints; and identify loud areas of the contact center based on the location, the other locations, the ambient noise level, and the additional ambient noise levels.

18. The apparatus of claim 11, wherein the program instructions further direct the apparatus to:

after the communication session and before a subsequent communication session, activate the secondary audio capture system to capture a second audio signal; and determine a second ambient noise level for the endpoint from the second audio signal.

19. The apparatus of claim 11, wherein:

a headset includes the primary audio capture system and at least one speaker that presents audio for the communication session to the user; and the endpoint includes the secondary audio capture system.

20. One or more non-transitory computer readable storage media having program instructions stored thereon for detecting ambient noise, the program instructions, when read and executed by a processing system, direct the processing system to:

during a communication session, receive an audio signal representing sound captured by a secondary audio capture system for an endpoint on the communication session, wherein a primary audio capture system for the endpoint captures voice communications from a user of the endpoint for the communication session;

determine an ambient noise level for the endpoint from the audio signal;

determine that the ambient noise level satisfies a loudness criterion, wherein the loudness criterion is satisfied when the ambient noise level exceeds a threshold value; and in response to determining that the ambient noise level satisfies the loudness criterion, present a notification to the user indicating that the ambient noise level has exceeded the threshold value.

* * * * *